US009809894B2

(12) United States Patent
Turner

(10) Patent No.: US 9,809,894 B2
(45) Date of Patent: Nov. 7, 2017

(54) METAL TREATMENT

(75) Inventor: Andrew Derek Turner, Abingdon (GB)

(73) Assignee: Accentus Medical Limited, Didcot (GB)

( * ) Notice: Subject to any disclaimer, the term of this patent is extended or adjusted under 35 U.S.C. 154(b) by 831 days.

(21) Appl. No.: 13/979,459

(22) PCT Filed: Jan. 13, 2012

(86) PCT No.: PCT/GB2012/050068
§ 371 (c)(1),
(2), (4) Date: Aug. 20, 2013

(87) PCT Pub. No.: WO2012/095672
PCT Pub. Date: Jul. 19, 2012

(65) Prior Publication Data

US 2013/0319869 A1 Dec. 5, 2013

(30) Foreign Application Priority Data

Jan. 14, 2011 (GB) ..... 1100605.3
Apr. 21, 2011 (GB) ..... 1106733.7

(51) Int. Cl.
*C25D 11/16* (2006.01)
*C25D 21/12* (2006.01)
*C25D 11/02* (2006.01)

(52) U.S. Cl.
CPC ..... *C25D 11/02* (2013.01); *C25D 11/024* (2013.01); *C25D 11/16* (2013.01); *C25D 21/12* (2013.01)

(58) Field of Classification Search
CPC ..... C25D 11/02–11/34
See application file for complete search history.

(56) References Cited

U.S. PATENT DOCUMENTS 4,487,666 A 12/1984 Bates
5,595,638 A * 1/1997 Konuma ..... C25D 11/02 205/106

(Continued)

FOREIGN PATENT DOCUMENTS

DE 102007026086 12/2008
WO WO 2010/112908 10/2010

OTHER PUBLICATIONS

Schroth et al., Machine Translation, DE 10 2007 026 086 A1 (2007).*

(Continued)

*Primary Examiner* — Bryan D. Ripa
*Assistant Examiner* — Ho-Sung Chung
(74) *Attorney, Agent, or Firm* — Christensen O'Connor Johnson Kindness PLLC

(57) ABSTRACT

In a process for anodizing a metal object (12), the metal object (12) is contacted with an anodizing electrolyte (32), and is first pre-anodized so as to grow a thin oxide film on the surface. The microscopic surface area is then deduced from electrical measurements either during pre-anodizing or on the pre-anodized surface. The metal object (12) can then be anodized. This is applicable when treating an implant to provide a surface that has the ability to incorporate biocidal material such as silver ions. The pre-anodizing uses a low voltage, for example no more than 2. V, and may take less than 120 seconds.

7 Claims, 2 Drawing Sheets

(56) References Cited

U.S. PATENT DOCUMENTS

| | | | | |
|---|---|---|---|---|
| 2004/0050709 | A1* | 3/2004 | Cadwell Stancin | C25D 11/08 205/213 |
| 2004/0060827 | A1* | 4/2004 | Riewe | C25F 5/00 205/640 |
| 2005/0045482 | A1* | 3/2005 | Storms | G21B 3/00 205/81 |
| 2009/0292346 | A1* | 11/2009 | Norlin | A61N 1/05 607/119 |
| 2010/0206733 | A1* | 8/2010 | Agg | A61L 27/32 205/50 |

OTHER PUBLICATIONS

Sato et al., Machine Translation, JP H04-032577 (1992).*
Sato et al., Partial Human Translation, JP H04-032577 (1992).*
S. Trasatti, "Real Surface Area Measurements in Electrochemistry", Pure Applied Chemistry, vol. 63, No. 5, pp. 711-734, Jan. 1, 1991.
International Search Report for International Application No. PCT/GB2012/050068, dated Jun. 10, 2013.
International Preliminary Report and Written Opinion for International Application No. PCT/GB2012/050068, dated Jul. 16, 2013.

* cited by examiner

METAL TREATMENT

The present invention relates to a method of treatment of a metal object to provide it with biocidal properties. In particular but not exclusively, the invention relates to a method of treating multiple metal objects simultaneously. The treatment provides objects that provide a reduced risk of infection when the object is implanted by a surgical procedure. It also relates to a method of anodising a metal object, and to a plant for treating metal objects.

In surgery, metal implants may be inserted into the tissue of the body, either into soft or hard tissue. In the case of cancer treatment of the bone for example, cancerous bone tissue is removed, and a prosthetic metal implant is used to replace that part of the bone that has been removed. Implants are also used for partial or full replacement of bones in joints (e.g. hips) and also in other fields such as dentistry and maxillofacial surgery. Implants for the foregoing (and other) uses may be of titanium metal or titanium alloy. Titanium metal and titanium alloys are biocompatible, relatively strong and relatively light.

There is a risk of introducing infection, or infection occurring, at the surface of metal implants. A way of treating an implant so that this risk of infection is suppressed is described in WO 2010/112908. This involves anodising the implant at a voltage typically up to 100 V, and then at a lower positive voltage, followed by brief application of a small negative voltage, so as to generate a hard oxide layer in which there are pits containing ion-absorbent material, into which silver ions are subsequently absorbed. To be sure that an implant has been sufficiently anodised, and so absorbs a sufficient level of silver ions, it was said that an anodising charge of between 2 and 5 coulombs/cm$^2$ should be passed, this being calculated on the basis of the microscopic surface area. The microscopic surface area can be determined by immersing the metal object in an electrolyte, and measuring the interfacial capacitance. The interfacial capacitance corresponds to the capacitance of the oxide at the metal surface in series with the double layer capacitance in the solution. The former depends on the oxide thickness; the latter depends on the composition of the electrolyte; and both depend on the microscopic surface area. The calculation of the surface area hence requires data about the initial surface oxide thickness (before it has been anodised), but it has been found that the initial oxide thickness is dependent on how the metal object has been previously treated. In particular if the object is conditioned by treatment with sodium hydroxide solution (caustic soda) it has been found that the resulting initial oxide thickness is significantly dependent on the temperature of the sodium hydroxide solution. Any uncertainty in the thickness of the oxide layer leads to an uncertainty in the calculated surface area.

The present invention accordingly provides, in a first aspect, a method of anodising a metal object, the method comprising:

contacting the metal object with an anodising electrolyte, and pre-anodising the surface so as to grow a thin oxide film on the surface;

making electrical measurements on the thin oxide film either during or after the pre-anodising step, and hence deducing the surface area of the metal object; and then anodising the metal object.

In a second aspect the invention provides a method of treating a metal object so as to incorporate a biocidal material in leachable form in the surface, the method comprising:

contacting the metal object with an anodising electrolyte, and pre-anodising the surface so as to grow a thin oxide film on the surface;

making electrical measurements on the thin oxide film either during or after the pre-anodising step, and hence deducing the surface area of the metal object;

then anodising the metal object to form an integral surface layer and to form pits through the integral surface layer; and then contacting the anodised metal object with a solution containing a biocidal material so as to incorporate said biocidal material into the surface layer.

The invention is applicable to metal objects formed of metals such as titanium and alloys of titanium, or other valve metals such as niobium, tantalum or zirconium or their alloys, and also to those plated or coated with such metals or their alloys. It is consequently suitable for treating metal implants. One standard alloy for this purpose is titanium 90% with 6% aluminium and 4% vanadium (British Standard 7252).

The geometric surface area of the metal implant can be determined by conventional means. This does not however take into account microscopic surface features or surface roughness of the metal. The ratio of actual microscopic to geometric area is known as the surface roughness factor; a polished surface typically has a surface roughness factor less than 2. The microscopic surface area can be determined for example from the interfacial capacitance. The pre-anodising of the surface ensures a consistent oxide thickness, and hence an accurate measurement of the microscopic surface area.

The pre-anodising is performed at a voltage less than that used during anodising. For example the pre-anodising may be performed with a voltage no more than 10 V, preferably less than 5 V, for example 2.5 V. This produces a thin oxide layer, considerably thinner than that conventionally produced by anodising because of the low voltage, but the layer is of consistent thickness. If the anodising is carried out in an electrolyte of 2 M aqueous phosphoric acid at about 20° C. it produces a film thickness of about 1.4 nm per volt, so anodising at 10 V produces an oxide film thickness of about 14 nm, anodising at 2.5 V produces a film thickness of about 3.5 nm, and anodising at 1.75 V produces a film thickness of about 2.5 nm. If a different electrolyte is used, such as sulphuric acid, the thickness may be slightly different. Hence the pre-anodising voltage may vary for different substrates and different electrolytes. Preferably the voltage is applied in a gradually increasing manner, for example increasing at a rate no more than 0.2 V/s, preferably no more than 0.1 V/s, for example 0.01 V/s, up to the peak or maximum value, and then held at this value until the current has significantly decreased. Preferably the voltage is held at the peak or maximum value for no more than 2 minutes, for example for 30 s. Preferably this pre-anodising stage takes no more than 10 minutes, more preferably no more 5 minutes, for example 2 minutes.

The voltage ramp rate should be such that the current does not exceed the current rating of the potentiostat power supply; this may be an issue with large surface area implants, for example those with a plasma sprayed surface. For example, at a ramp rate of 0.007 V/s a current of 0.024 mA/cm$^2$ of microscopic area has been observed. Typically, at a ramp rate of 0.1 V/s, there is a film growth current of about 0.3 mA/cm$^2$ for a polished surface, and the current is directly proportional to the ramp rate. These currents also depend on the material and the anodising conditions. For example if twenty implants each of 4,000 cm$^2$ microscopic surface area are pre-anodised simultaneously, a ramp rate of 0.01 V/s would give a net film growth current of about 2.4 A (well within the current capacity of a 10 A power supply).

The pre-anodising enables the microscopic surface area to be measured. Preferably this is performed without removing the metal object from the electrolyte in which pre-anodising took place. It may be done after pre-anodising, by measuring the interfacial capacitance of the pre-anodised surface; this may be performed by applying a varying voltage waveform, such as a triangular waveform or a sinusoidal waveform, and this waveform should be such that both the mean voltage and the maximum voltage are less than the peak voltage used during pre-anodising. Furthermore the voltage minima should be well above the voltage for hydrogen evolution, which becomes significant at about −0.5 V, to ensure hydrogen evolution does not occur. Preferably the varying voltage waveform is therefore combined with a positive bias voltage, such that the voltage minima are greater than zero, to ensure accuracy of the measurements. From such measurements the interfacial capacitance, and hence the microscopic surface area, can be deduced by comparison with calibration standards. Typically this is performed by comparison to a polished surface, so that the resulting value of microscopic surface area (which may be referred to as the "polished microscopic surface area") is that polished area that would have the same interfacial capacitance. The pre-anodising ensures a uniform and consistent oxide thickness, so an accurate measurement of microscopic surface area is possible.

Alternatively the microscopic surface area can be deduced from the measurements of current during the pre-anodising step. Where the voltage is gradually and steadily increased during pre-anodising, it has been found that the current has a substantially constant or plateau value over a range of voltages. For example if the voltage is gradually and steadily raised from 0 to 2.5 V during pre-anodising, it has been found that there may be a substantially constant value of current for voltages between about 1.0 V and 2.0 V; similarly, if the voltage is gradually and steadily raised from 0 to 1.75 V during pre-anodising, it has been found that there is a substantially constant value of current for voltages between about 1.5 V and 1.7 V. This constant value of current is directly proportional to the microscopic surface area. Hence, by means of a calibration, the microscopic surface area can be deduced from the constant value of current. If the calibration is by comparison to a polished surface, the surface area that is deduced (which may be referred to as the "polished microscopic surface area"), is the polished surface area that would draw the same current during pre-anodising.

It has been found that the microscopic surface area deduced from interfacial capacitance measurements is the same as the microscopic surface area deduced from plateau current during pre-anodising. This indicates that both the interfacial capacitance and the plateau current are proportional to the microscopic surface area.

Preferably the anodising step comprises anodising the metal object to passivate it by forming an integral surface layer; continuing the application of an anodising voltage to produce pits through the integral surface layer; and then producing a hydrous metal oxide or phosphate in the pits by electrochemical or chemical reduction in contact with an electrolyte or a solution. After the metal object has been anodised it is removed or separated from the electrolyte or the solution, and rinsed, before being contacted with the solution containing a biocidal material.

This anodising procedure ensures satisfactory ion-absorbing capacity in the anodised surface. The voltage applied during pit formation may be less than the maximum voltage applied during passivation. The pit formation preferably uses the same electrolyte as that used during passivation, although as an alternative the surface may be passivated in one electrolyte; and the object then put into contact with a second electrolyte for the pit formation.

During passivation the maximum voltage applied determines the thickness of the oxide film. Lower voltages applied subsequently do not affect the film thickness. The maximum voltage may be as high as 2000 V, but is more typically between 30 V and 150 V, for example 100 V. The voltage during passivation may be applied as a voltage increasing linearly with time to a maximum, limiting value, or alternatively the voltage may be increased in steps up to the maximum value.

During pit formation the voltage applied may have a lower value. This has the effect of increasing both the rate and extent of pit development. Preferably the applied voltage during pit formation is between 15 V and 80 V such as 25, 30, or 75 V. Desirably it is between 20 V and 60 V, for example 25 V, 27 V or 30 V. Pit growth may also be promoted by re-starting the anodising process, which may be done multiple times.

The invention preferably also involves monitoring the electrical current provided to the object throughout the anodisation. Preferably during anodisation the electric current is supplied to the metal object through a low value, high power resistor (e.g. 1Ω). The current supplied to that metal object can hence be monitored by the voltage drop across the resistor. When the process is applied to multiple metal objects simultaneously, each metal object is preferably connected to a source of electric current by a respective resistor, so that the current supplied to each metal object can be monitored. A different current sensing device may be used instead of the resistor, such as a Hall effect current sensor; or a sensing circuit such as a current follower.

Preferably the object is thoroughly cleaned before it is contacted with the anodising electrolyte. The cleaning procedure preferably comprises degreasing in a suitable detergent or solvent e.g. acetone, rinsing with water, contacting with caustic soda, and further rinsing with water. The caustic soda, i.e. aqueous sodium hydroxide solution, typically between 0.5 and 2.0 M, for example 1 M, removes any traces of grease, and can assist in reducing bioburden on the metal object by destroying bacteria, prions or endotoxins. It also conditions the surface.

Preferably each rinsing process is performed using flowing water (preferably de-ionised to <1 μS/cm). Where the rinsing is intended to remove an ionic material, the rinse water may be passed through a tube in which is a conductivity measuring electrode, and the rinsing process is terminated when the conductivity drops below a threshold indicative of clean water.

The electrolyte may be acid or alkaline. For example it may be phosphoric acid at a concentration between 0.01 M and 5.0 M, typically from 0.1 M to 3.0 M and in particular between 1.8 and 2.2 M, in a solvent such as water. Other electrolytes such as sulphuric acid, phosphate salt solutions or acetic acid may be used. Preferably, the pH of the acidic electrolyte should be maintained within the range of $0.5<pH<2.0$, more ideally within the range $0.75<pH<1.75$. If an alkaline electrolyte is used the pH is preferably greater than 9 and more typically the pH is in the range of 10-14. The alkaline electrolyte can be a phosphate salt such as $Na_3PO_4$, or may be sodium hydroxide, NaOH.

The present invention also provides metal implants produced by such methods. The present invention also provides a plant for performing the method.

Implants according to the invention can be used for many medical and surgical purposes, including full and partial hip replacements, implants useful in maxillofacial, trauma, orthodontal and orthopaedic applications, and dental implants.

The invention will now be further and more particularly described, by way of example only, with reference to the accompanying figures, in which.

IMPLANT-TREATING PLANT

Figure 1:
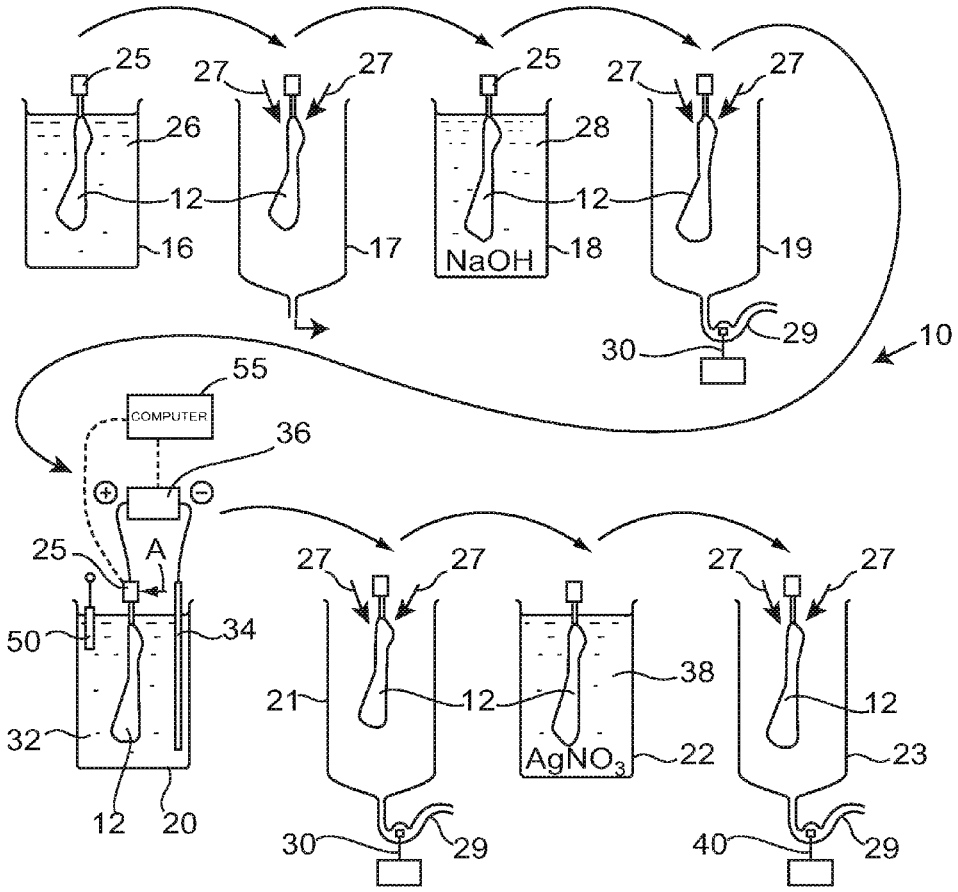
FIG. 1 shows a diagrammatic side view of a plant for treating implants to provide the surfaces with biocidal properties.
Figure 2:
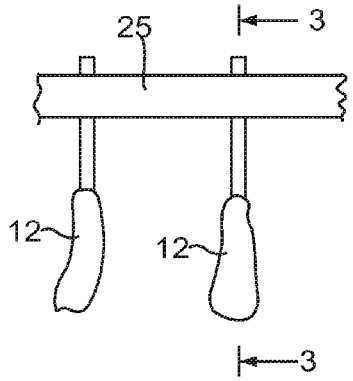
FIG. 2 shows a view in the direction of arrow A of FIG. 1, showing a bus bar.

Referring to FIG. 1 there is shown a plant 10 for treating implants 12, such as hip joint implants. Where identical features are present in more than one part of the plant 10 they are referred to by the same reference numerals. The implants 12 may be of titanium alloy. The plant 10 comprises eight different tanks 16, 17, 18, 19, 20, 21, 22 and 23 for successive stages of the treatment, and enables several implants 12 to be treated at each stage simultaneously. In each case one or more implants 12 can be supported by a bus bar 25 so that the implants 12 are within the respective tank 16-23. As shown in FIG. 2 there may be a number of implants 12 attached at different positions spaced apart along a bus bar 25.

The first four tanks 16-19 are for cleaning and conditioning of the implants 12; it will be appreciated that if the implants 12 are already adequately clean, the first four tanks 16-19 would not be required. In the first tank 16 the implants 12 are immersed in a suitable detergent or acetone 26 to dissolve any grease from their surfaces. They may also be subjected to ultrasound to enhance the cleaning process, for example using ultrasonic transducers (not shown) attached to the wall of the tank 16. On removal from the tank 16, the implants are flushed with clean detergent or acetone into the tank 16 to replace any lost by evaporation and to remove any residues. The implants 12 are then transferred to the second tank 17 in which they are rinsed with clean water from jets 27, the rinse water passing to waste from the base of the tank 17. The implants 12 are then transferred to the third tank 18 which contains sodium hydroxide aqueous solution 28 (in the range 0.2-2.0 M, and preferably 0.8-1.2 M). This ensures removal of any traces of grease that remain, conditions the surfaces, and destroys any prions or endotoxins that may be present. The implants may also be subjected to ultrasound while immersed in the sodium hydroxide solution to enhance the cleaning process, for example using ultrasonic transducers (not shown) attached to the wall of the tank 18. The implants 12 are then transferred to the fourth tank 19 in which they are rinsed with de-ionised water from jets 27. The rinse water flows out of the base of the tank 19 through a U-tube 29 in which is a conductivity sensor 30. When the conductivity falls below a threshold value the rinsing process is finished. It will be appreciated that the cleaning and conditioning in the tanks 16-19 may instead use different liquids.

The implants 12 are then transferred to the fifth tank 20 in which anodisation is carried out. This tank 20 contains an electrolyte 32, in this example, 2.1 M phosphoric acid in water (i.e. an aqueous solution). The implants 12 are immersed in the electrolyte 32, and in addition a platinised titanium electrode 34 is also immersed in the electrolyte 32 to act as a counter-electrode. The bus bar 25 and the electrode 34 are connected to the output terminals of a voltage supply module 36. The anodisation process will be described in more detail below.

When anodisation has been completed, the implants 12 are then transferred to the sixth tank 21 in which they are rinsed with de-ionised water from jets 27. The rinse water flows out of the base of the tank 21 through a U-tube 29 in which is a conductivity sensor 30. When the conductivity falls below a threshold value this rinsing process is complete. The implants 12 are then transferred into the seventh tank 22, which contains aqueous silver nitrate solution 38, and are immersed typically for between 0.5 hours and 2 hours with gentle agitation, for example 1 hour. The solution 38 has a silver concentration in the range of from 0.001 to 10 M, e.g. 0.01 to 1.0 M, for example, 0.1 M or thereabouts. In a specific example the implants 12 would be immersed in 0.1 M silver nitrate solution 38 for 1 hour. The time required may be modified by changing the pH of the silver nitrate solution, for example by adding an acid such as nitric acid, or by adding an alkali such as sodium hydroxide, or contacting the silver nitrate solution with silver hydroxide.

The implants 12 are then again rinsed, by being transferred to the eighth tank 23 in which they are rinsed with de-ionised water from jets 27. The rinse water flows out of the base of the tank 23 through a U-tube 29 in which is a silver-ion-specific electrode 40. When the level of silver ions in the rinse water falls below a threshold, the rinsing process is complete. The implants 12 may then be left to dry under ambient conditions, or may be blown dry with an air jet (not shown). The implants may be subjected to additional cleaning stages to further control bioburden; they may be dried by vacuum oven drying; they may be packaged under sterile conditions for storage or transport; and they may be subjected to sterilisation e.g. gamma irradiation.

Figure 3:
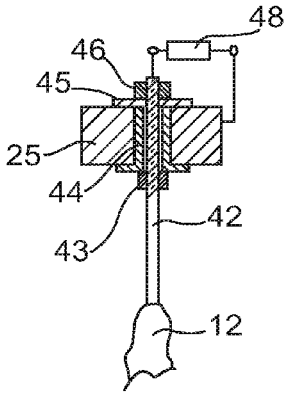
FIG. 3 shows a cross-sectional view on the line 3-3 of FIG. 2.

Referring to FIG. 3, each implant 12 is connected to the bus bar 25 by a support rod 42 which passes through a hole through the bus bar 25. A top portion of the support rod 42 is threaded, and below the bus bar 25 there is a nut 43 welded to the support rod 42. An insulating sleeve 44 with a flange locates within the hole, so the flange separates the nut 43 from the underside of the bus bar 25. Above the bus bar 25 is an insulating washer 45 and a nut 46, so the support bar 42 can be clamped securely to the bus bar 25 by tightening the nut 46. The top end of the support rod 42 is connected electrically via a 1Ω resistor 48 to the bus bar 25. As shown in FIG. 1, when installed in the anodisation tank 20 the bus bar 25 and the electrode 34 are connected to the output terminals of the voltage supply module 36. The anodisation tank 20 is also provided with a standard reference electrode 50, which may for example be a Ag/AgCl electrode, or a dynamic reference electrode derived from the electrolysis of the electrolyte between two platinum wires under a constant applied current. A computer and data logger 55 is arranged to monitor and record the voltages applied to the bus bar 25 by the voltage supply module 36, and so applied to the implants 12; and the computer and data logger 55 is also arranged to monitor the voltages across each of the 1Ω resistors 48, and hence the electrical current and electric charge supplied to each individual implant. The bus bar 25 may be connected electrically to earth (so the counter electrode is at a negative voltage), to ensure large voltages are not applied to the computer and data logger 55.

Pre-Anodising Step

Before performing anodisation, the implants 12 are pre-anodised by applying a voltage between the bus bar 25 (and so the implants) and the counter-electrode 34, so that the implants 12 are the anode. The applied voltage is gradually increased to a peak or maximum value such that the voltage between the implants and the Ag/AgCl reference electrode 50 reaches say 1.75 V or 2.5 V, and is then held at this voltage until the current decreases to a negligible value. Preferably the voltage is applied for no more than 10 minutes in total. For example the voltage may be ramped at 0.1 V/s up to 2.5 V, so taking 25 seconds, and held for a further 60 seconds. This passivates the surface, forming a uniform oxide layer of thickness 3.5 nm. Alternatively it may be ramped at 0.01 V/s up to 1.75 V, so taking 175 s, and then held at 1.75 V for a further 120 s; this would form an oxide layer of thickness about 2.5 nm. Throughout pre-anodising and the surface area measurement, and the voltage reversal, all the voltages quoted are with reference to the Ag/AgCl electrode 50, which is at about +0.22 V versus a standard hydrogen electrode. If a different reference electrode were used, the voltage values would need to be adjusted accordingly.

Measurement of Microscopic Surface Area (1)

The microscopic surface area of each implant 12 is then measured, in situ, by reducing the applied voltage to 1.0 V and applying a triangular wave voltage variation which is 0.1 V peak-to-peak, i.e. varying between 0.95 V and 1.05 V, at a frequency typically between 0.5 Hz and 2.5 Hz. From the charge that is transferred to or from an implant 12 during such a voltage variation, the interfacial capacitance can be calculated, and hence the microscopic surface area deduced. The capacitance per unit area depends upon the electrolyte concentration, and the temperature, as well as the oxide thickness; these dependencies can be determined by calibration with standard samples.

Where larger implants 12 are concerned, it may be preferable to use a lower frequency, and for smaller implants a higher frequency may be required, preferably no more than 10 Hz, more preferably no more than 5 Hz. In an alternative measurement process, a sinusoidal voltage variation is applied, and the component of the current in quadrature to the voltage variation is measured, and can be related to the interfacial capacitance. As with the triangular wave voltage, the measurements are most accurate if the voltage does not cross the zero line, so the sinusoidal voltage variation is applied along with a bias voltage.

Deducing the microscopic surface area from such measurements of the interfacial capacitance provides accurate results, but it is not necessarily applicable if the implant 12 defines an internal hole or lumen. This is because the hole or lumen acts as a transmission line at such frequencies as are suitable for this measurement, so that only part of the surface area of the hole can be measured.

Measurement of Microscopic Surface Area (2)

An alternative method of deducing the microscopic surface area is based on measurements of the electrical current during the pre-anodising step. As the voltage is gradually increased, the thickness of the oxide film also increases, and so the electric current creating the oxide film is substantially constant. If other electrolysis processes also occur, then the current will increase, for example if oxygen evolution occurs then the current would rise. This is typically found to occur above about 2.5 V. As long as oxygen evolution is not occurring, so that the only effect of the electrolysis is the development of the oxide film, then the current will be constant.

Figure 4:
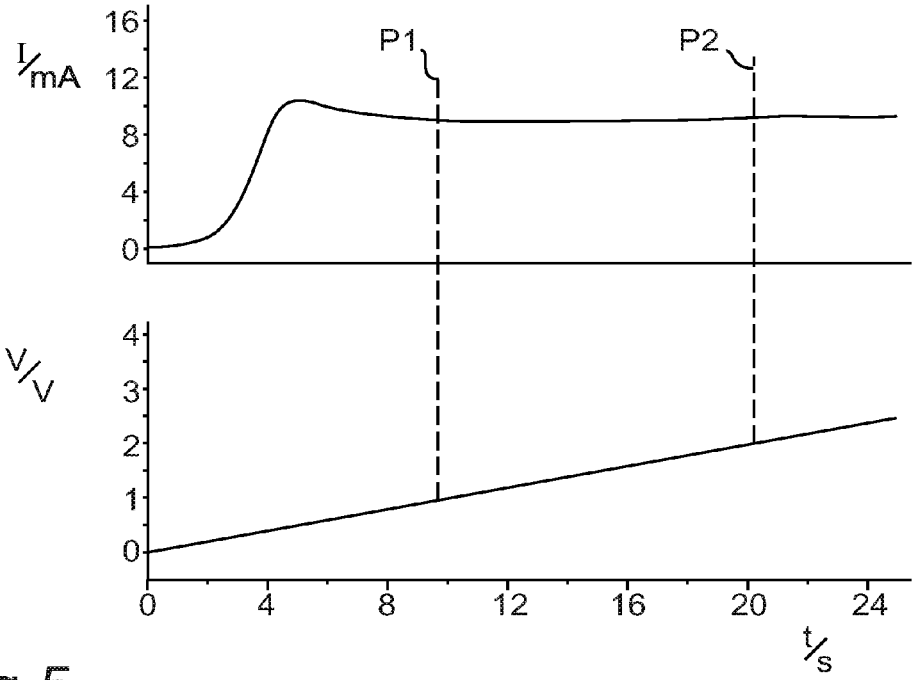
FIG. 4 shows graphically variations of electrical parameters during pre-anodising of a disc.

Referring now to FIG. 4, this shows graphically the variation in electrical parameters (current, I, and voltage, V) with time, t, during the pre-anodising of a polished Ti6Al4V alloy disc. The bottom graph shows the variation of voltage: the voltage starts at zero, and is steadily increased at 0.1 V/s up to a maximum value of 2.5 V over 25 seconds. The upper graph shows the variations in current, I, during this process. The current increases, first gradually and then more rapidly, to an initial peak about 5 seconds after the start, and then decreases to a plateau or constant value. During the last few seconds before the maximum voltage is reached the current increases very slightly, presumably due to onset of oxygen evolution. Although not shown in FIG. 4, the voltage is then held at the maximum value, 2.5 V, for another 120 seconds, and the current rapidly decreases.

It has been found that the values of the plateau current, which in this example may be taken as the values of current at 1.5 V, or the mean value between 1.0 V and 2.0 V as indicated by the vertical broken lines P1 and P2, give an accurate indication of the microscopic surface area of each specimen. For specimens of the alloy Ti4% Al6% V, in 2.1 M aqueous phosphoric acid at 20° C., and a voltage ramp rate of 0.1 V/s, the plateau value of current is 0.34 mA/cm$^2$ of microscopic surface area (calibrated against a polished surface, as discussed previously). The measurements of surface area deduced from the plateau current have been found to agree with those deduced from capacitance measurements to an accuracy typically better than 2%.

Measurement of surface area from this plateau current requires that a plateau is achieved. If a specimen has been pretreated with nitric acid, it may to some extent already have an oxide coating, and in this case it may be necessary to perform the pre-anodising to a slightly higher maximum voltage such as 3.5 or 4 V, in order to reach a plateau in the current variation.

Figure 5:
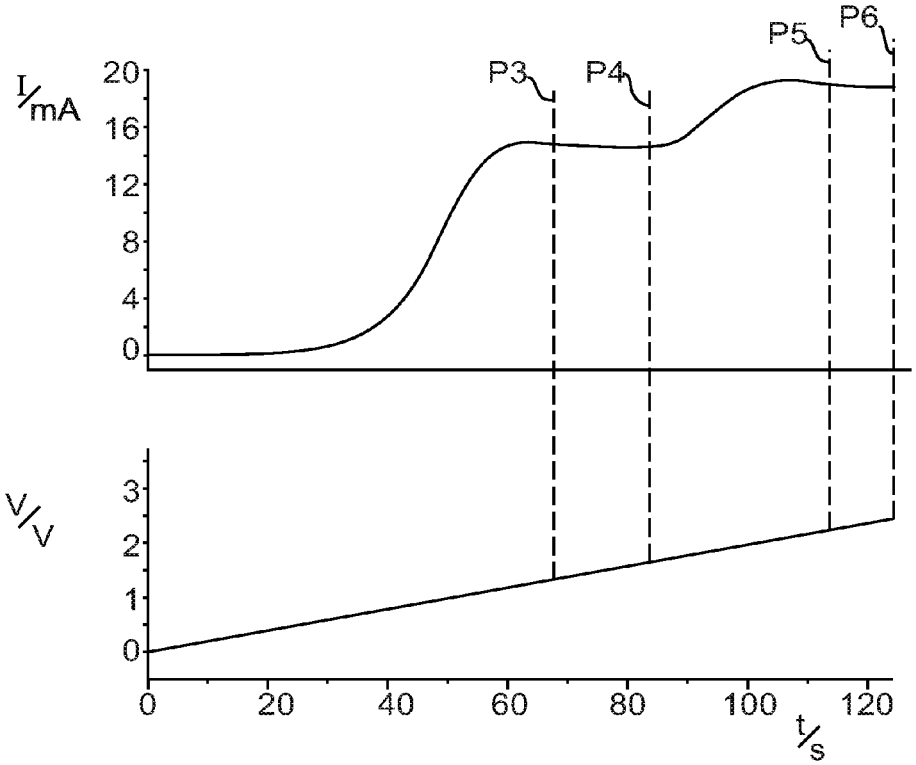
FIG. 5 shows graphically variations of electrical parameters during pre-anodising of nail with a lumen.

Referring now to FIG. 5, this shows the corresponding graphs of current and voltage variation for a nail of the same Ti6Al4V alloy, the nail having a central lumen or hole. In this case the surface area was larger than for the disc described in relation to FIG. 4, so the voltage was increased at only 0.02 V/s (to ensure that the current did not exceed 25 mA/cm$^2$). The increase from 0 to 2.5 V consequently took 125 seconds. The current graph shows two successive plateaus, a first plateau between about 1.3 V and 1.6 V (indicated by the vertical broken lines P3 and P4), and a second plateau between about 2.2 V and 2.5 V (indicated by the vertical broken lines P5 and P6). The first plateau corresponds to oxide formation only on the outer surface of the nail, but when the voltage is sufficiently high then film growth starts on the inside surface (the surface of the lumen) so the second plateau of current corresponds to oxide formation on both the outer surface and the inner surface.

The relationship between the microscopic area, Am, and the plateau current, Ip, depends on the ramp rate, R, at which the voltage is increased. It can be expressed as:

$$Ip=k\times R\times Am \text{ and so: } Am=Ip/(k\times R)$$

where k is a constant which depends upon the material. If the calibration is with reference to a polished surface, as discussed previously, then for the titanium alloy Ti6Al4V the value is:

$$k=3.4\ \text{mA}\cdot\text{s}/(\text{cm}^2\cdot\text{V})$$

whereas for chemically pure titanium it is:

$$k=2.97\ \text{mA}\cdot\text{s}/(\text{cm}^2\cdot\text{V}).$$

The Anodising Process

The anodising process can then be carried out. For example the implants 12 may be anodised using a maximum voltage of 100 V, to produce a hard wearing anodised oxide surface layer. In this example the electrolyte 32 is 2.1 M phosphoric acid at about 20° C., and the voltage may be increased gradually at for example 1 V/s up to the maximum value, with the implants 12 as the anode and the counter-electrode 34 as the cathode (as indicated in FIG. 1). Alternatively the target or maximum voltage may be reached by limiting the microscopic current density so it does not exceed for example 5 mA/cm$^2$. The anodising current results in formation of an oxide layer that is integral with the titanium metal substrate, passivating the surface. The current falls to a low level once the maximum voltage has been achieved, for example to less than 1 mA/cm$^2$ (of microscopic area), and this low level of current indicates that passivation has been completed.

The anodising voltage is then maintained to form pits in the surface, the pits typically having depths in the range 1 to 3 μm penetrating through the outer passive hard oxide layer (which is 0.14 μm thick at 100 V) into the substrate, and have typical diameters of 1 to 5 μm. The pits may occupy some 5 to 20% of the surface area, so they do not significantly affect the hard wearing properties of the hard surface layer. If the anodising voltage is maintained at the maximum value, 100 V, the pit formation typically takes a further 2 or 3 hours, whereas if the voltage is reduced to 27 V after passivation, for example, the pit formation is more rapid, and may be completed in less than 0.5 h, although this depends upon the composition of the alloy. For some applications, where a high silver loading is required rather than such a hard wearing surface, the pit formation step may be carried out for longer so that the pits occupy up to 50% of the surface area.

Once the passivation and the production of pits to a required format are complete, the implants 12 are subjected to a brief voltage reversal, that is to say making the implants 12 the cathode and the counter electrode 34 the anode. With the electrolyte 32, the reversed voltage is between −0.2 and −0.7 V, for example about −0.45 V (as measured with respect to the Ag/AgCl standard reference electrode 50), to ensure that the solvent, water, is not electrolysed, but that a reduction process is able to take place. During this period of reversed voltage, certain titanium species are electrochemically reduced within the pits to high surface area, low solubility, hydrous titanium oxide species, and so the pits fill with this high surface area inorganic medium, and the current through the implant drops and eventually falls to zero or substantially zero. The reversed voltage step may take from 60 to 180 s.

The computer and data logger 55 is arranged to monitor and record the applied voltages, the measured capacitance, and the anodising currents and their variations with time for each of the implants 12, during both the pre-anodising step and the anodising process. The computer and data logger 55 can hence deduce, for each implant 12, the electrical charge per unit area (on a microscopic basis) during each stage of anodisation. This provides for quality assurance of the manufacturing process. In addition the computer and data logger 55 may be arranged also to monitor and record measurements from the other stages of the process (e.g. conductivity as a measure of concentration, temperature and pH) as well as rinse water conductivity sensors 30 to provide assurance that each implant 12 has been satisfactorily rinsed.

Although in FIG. 1 the tank 20 is shown as holding only one bus bar 25 carrying implants 12, it will be appreciated that the tank 20 might be large enough to contain and treat implants 12 attached to several bus bars 25 simultaneously; and the tank 20 might include more than one counter electrode 34. As another modification, rather than having a single implant 12 attached at each position along a bus bar 25, when treating small items such as pins or screws, more than one item may be attached at each position, although this has the disadvantage that the current is not separately monitored to those individual items. In place of the platinised titanium counter electrode 34 described above, the counter electrode 34 might be of a different material such as titanium coated with gold; or of solid platinum; or of a mixed oxide (iridium/titanium or Ir/Pt/titanium oxide) on titanium; or of glassy carbon; in any event it must not react with the electrolyte, and must not be affected by the negative and positive applied voltages.

It will be appreciated that the above description is by way of example. In particular the anodisation may be performed with different voltage values, although for passivation the voltage is preferably greater than 35 V and more preferably greater than 75 V. As previously intimated the pit formation may be carried out at a lower voltage than the passivation stage. Where the anodising is carried out at 100 V in both the passivation and pit formation steps, typically the total charge passed is in the range 2 to 5 C/cm$^2$, but if the pit formation is carried out at a lower voltage satisfactory results may be obtained for somewhat less charge, for example down to 0.5 C/cm$^2$ of microscopic area, because the process is somewhat more efficient at lower voltage.

The third stage of anodising is the reduction to produce a hydrous metal oxide or phosphate in the surface layer, and this preferably comprises applying a negative voltage to the metal object after passivation and pit-formation, while the metal object remains in contact with the anodising electrolyte as described above. This avoids the need for any additional electrolytes or solutions. As a second option, the metal object that has been subjected to passivation and pit-formation may then be put into contact with an electrolyte solution containing a reducible soluble salt of titanium or of the substrate metal, and subjected to a negative voltage to bring about electrochemical reduction. As a third option, instead of performing electrochemical reduction, the metal object may be contacted with a chemical reducing agent.

A suitable surface concentration of silver, on a geometric basis, is in the range 1 to 30 μg/cm$^2$, more typically in the range 1 to 15 μg/cm$^2$, preferably 2 to 10 μg/cm$^2$; such concentrations are efficacious in suppressing infection, but are not toxic. In some situations it will be appreciated that still higher silver loadings may be desirable, that are efficacious in suppressing infection, but are not toxic. In use of the treated implant 12 it is thought that during exposure to body fluids there is a slow leaching of silver species from the surface, from the anodised layer, so that the growth of microorganisms such as bacteria, yeasts or fungi in the vicinity of the metal object is inhibited. The leaching is thought to be effected by ion exchange of silver on the metal object with cations such as sodium in body fluid that contacts the metal object. Other mechanisms can occur, such as the oxidation to ionic species of any photo-reduced silver retained in the hydrous metal oxide as a result of the localised oxygen levels, to produce the released silver ions which can go on to kill or suppress the growth of the microorganisms or biofilm formation. The rate at which silver ions are leached from the surface, and the initial quantity of silver in the surface, are sufficient to ensure the implant has a biocidal effect for several weeks after implantation.

It is to be understood that references herein to silver as a biocidal metal also apply to other biocidal metals, such as copper, gold, platinum, palladium or mixtures thereof, either alone or in combination with other biocidal metal(s).

It is to be understood that additional coatings, for example those to enhance osseointegration such as tri-calcium phosphate or hydroxyapatite, may be provided on the surface of the implants following the anodisation as described above.

What is claimed:

1. A method of anodising a metal object, the method comprising:

contacting the metal object with an anodising electrolyte, and pre-anodising the surface so as to grow a thin oxide film of consistent thickness on the surface by applying an anodising voltage and gradually increasing the anodising voltage up to a maximum pre-anodising voltage, and then holding at this voltage until the current has significantly decreased, wherein the maximum pre-anodising voltage relative to an Ag/AgCl electrode is less than 10V;

making electrical measurements on the thin oxide film during the pre-anodising step, and hence deducing the surface area of the metal object; and then anodising the metal object using conditions calculated on the basis of the deduced surface area;

wherein the surface area is deduced from a measurement of electrical current during the pre-anodising step, wherein the variation in electrical current with time as the applied voltage is increased has at least one plateau portion wherein the current is substantially constant over a range of applied voltage during the pre-anodising step, and the measurement of electrical current is the average current over a plateau portion of the current variation.

2. A method of treating a metal object so as to incorporate a biocidal material in leachable form in the surface, the method comprising:

contacting the metal object with an anodising electrolyte, and pre-anodising the surface so as to grow a thin oxide film of consistent thickness on the surface by applying an anodising voltage and gradually increasing the anodising voltage up to a maximum pre-anodising voltage, and then holding at this voltage until the current has significantly decreased, wherein the maximum pre-anodising voltage relative to an Ag/AgCl electrode is less than 10V;

making electrical measurements on the thin oxide film either during or after the pre-anodising step, and hence deducing the surface area of the metal object;

then anodising the metal object to form an integral surface layer and to form pits through the integral surface layer, using conditions calculated on the basis of the deduced surface area; and then contacting the anodised metal object with a solution containing a biocidal material so as to incorporate said biocidal material into the surface layer;

wherein the surface area is deduced from a measurement of electrical current during the pre-anodising step, wherein the variation in electrical current with time as the applied voltage is increased has at least one plateau portion wherein the current is substantially constant over a range of applied voltage during the pre-anodising step, and the measurement of electrical current is the average current over a plateau portion of the current variation.

3. A method as claimed in claim 2 wherein the pre-anodising takes no more than 10 minutes.

4. A method as claimed in claim 2 wherein the anodising step comprises anodising the metal object to passivate it by forming an integral surface layer; continuing the application of an anodising voltage to produce pits through the integral surface layer; and then producing a hydrous metal oxide or phosphate in the pits by electrochemical or chemical reduction in contact with an electrolyte or a solution.

5. A method as claimed in claim 2, wherein, after the metal object has been anodised it is removed or separated from the electrolyte or the solution, and rinsed, before being contacted with the solution containing a biocidal material.

6. A method as claimed in claim 2 comprising monitoring the electrical current provided to the object during anodisation.

7. A method as claimed in claim 6 wherein during the anodising step the electric current is supplied to the metal object through a resistor.

* * * * *